United States Patent [19]

Lanham

[11] Patent Number: 5,010,802

[45] Date of Patent: Apr. 30, 1991

[54] ELECTRO-ACOUSTIC CONNECTOR FOR AMPLIFIED MUSICAL INSTRUMENTS

[76] Inventor: Terry M. Lanham, 4833 Meadow Lark La., Waldorf, Md. 20601

[21] Appl. No.: 450,962

[22] Filed: Dec. 15, 1989

[51] Int. Cl.[5] ..... G10H 3/18

[52] U.S. Cl. ..... 84/743

[58] Field of Search ..... 84/723–746

[56] References Cited

U.S. PATENT DOCUMENTS

| | | | |
|---|---|---|---|
| 4,519,287 | 5/1985 | Naruse | 84/743 |
| 4,532,847 | 8/1985 | Youngblood | 84/743 X |
| 4,941,389 | 7/1990 | Wendler | 84/743 X |

*Primary Examiner*—Stanley J. Witkowski
*Attorney, Agent, or Firm*—John C. Smith, Jr.

[57] ABSTRACT

An electro-acoustic connector for use with a musical instrument, such as a guitar, connected to an electronic amplifier and adapted to receive electrical signals from a transducer associated with the musical instrument and to receive and transmit soundwaves to a microphone incorporated therein. A three-position switch in the electro-acoustic connector controls the transmission to the amplifier of electrical signals from the transducer associated with the musical instrument and/or electrical signals from the microphone.

6 Claims, 2 Drawing Sheets

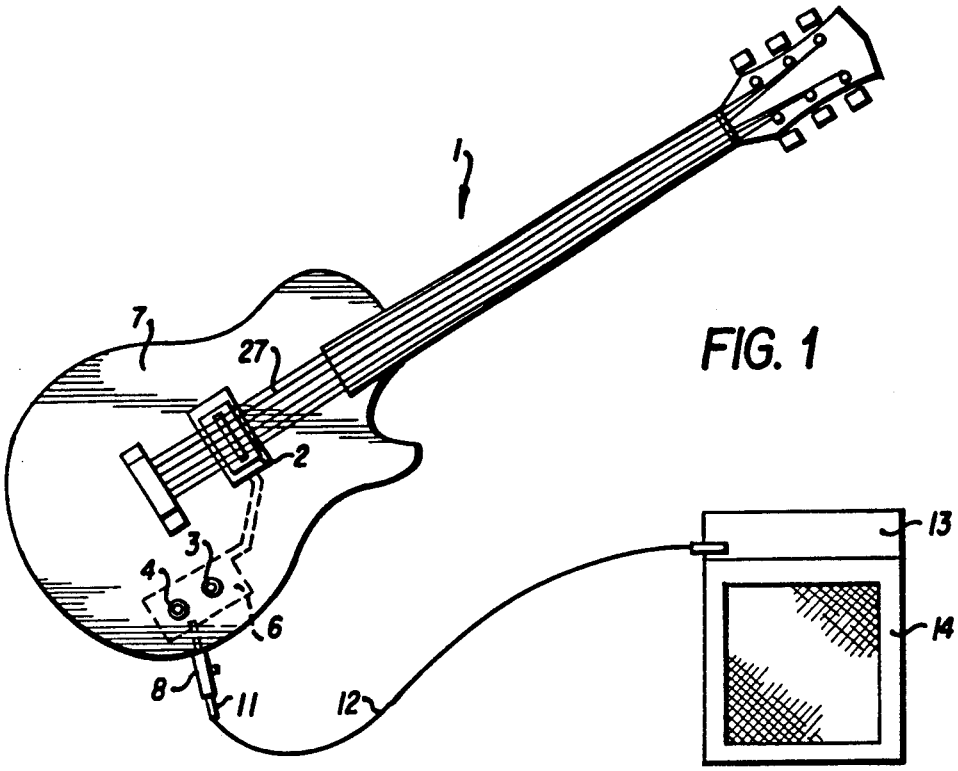
FIG. 1
FIG. 4
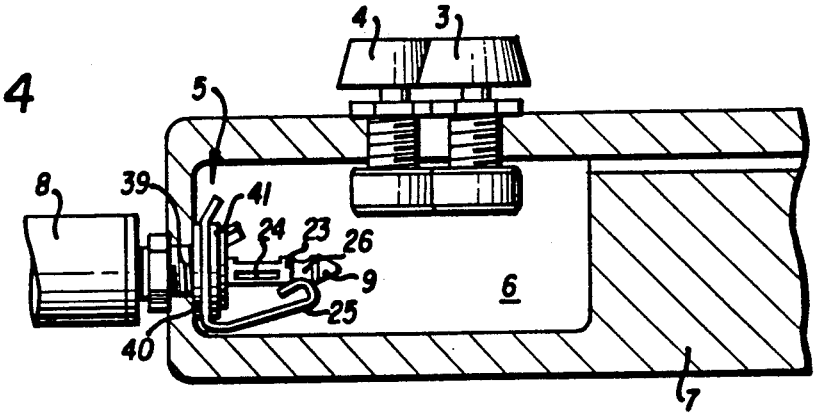
FIG. 5
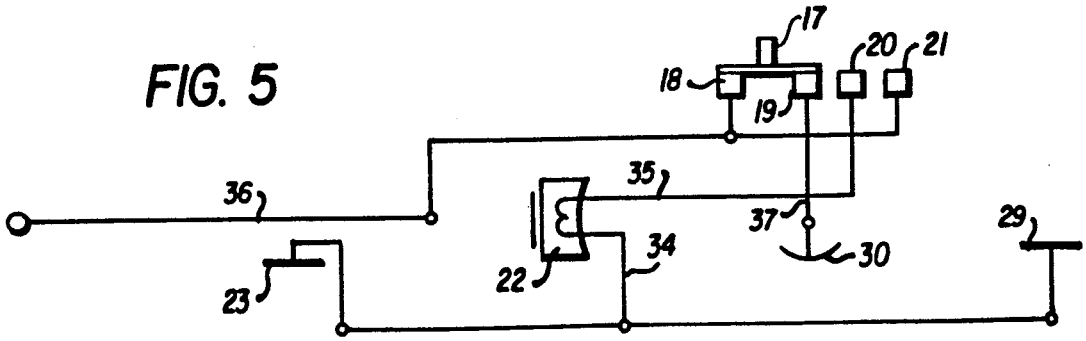

III
III

ELECTRO-ACOUSTIC CONNECTOR FOR AMPLIFIED MUSICAL INSTRUMENTS

BACKGROUND OF THE INVENTION

This invention relates to an electro-acoustic connector for use with musical instruments adapted to be connected to an electronic amplifier. The electro-acoustic connector is adapted to control transmission of electrical signals generated by a transducer, such as an electromagnetic pickup, vibration transducer or piezoelectric element, associated with the musical instrument or by a microphone contained in the electro-acoustic connector adapted to receive soundwaves from the musical instrument.

Musical instruments, such as a guitar, which are adapted to be connected to an electronic amplifier normally have a transducer, such as an electro-magnetic pickup, vibration transducer, or piezoelectric element, which is connected by a patch cord to a jack receptacle mounted in the body of the musical instrument. Normally, a jack connected to the electronic amplifier is inserted in the jack receptacle for the transmission of electrical signals from the transducer to the amplifier. The body of the guitar or other instrument is normally made of solid wood and does not have a soundwave amplifying chamber.

The sound emitted by the amplifier-speaker connected directly to a transducer, such as an electromagnetic pickup, vibration transducer or piezoelectric element, associated with a musical instrument has different characteristics compared with the sound generated by an amplifier-speaker connected to a microphone responsive to soundwaves generated by the same musical instrument. The electro-acoustic connector of the present invention permits the musician playing a musical instrument designed for use with an electronic amplifier to conveniently control the transmission of electrical signals to the amplifier from both the transducer associated with the musical instrument and the microphone, thereby controlling the quality of the sound emitted by the speaker.

It is known in the prior art to modify the musical instrument by installing a microphone in or on the musical instrument with a jack receptacle for connection by a patch cord to an amplifier.

An object of the present invention is an electro-acoustic connector adapted to transmit electrical signals directly from a conventional transducer such as an electromagnetic pickup, vibration transducer or piezoelectric element mounted on a musical instrument directly to an electronic amplifier and/or receive soundwaves generated by the musical instrument and convert said soundwaves into electric signals for transmission to said amplifier without modification of the musical instrument.

Another object of the present invention is to provide an electro-acoustic connector having a jack which may be inserted in the conventional jack receptacle in the body of the musical instrument and which is adapted to receive and transmit electrical signals from the transducer of the musical instrument to the amplifier and/or receive soundwaves from the musical instrument, a microphone disposed in the electro-acoustic connector being responsive to the soundwaves and generating electrical signals which are transmitted to the amplifier.

SUMMARY OF THE INVENTION

The electro-acoustic connector of the present invention comprises a housing having a jack for insertion in a jack receptacle of a musical instrument and a jack receptacle for receiving a jack connected to an electronic amplifier. Thus, the electro-acoustic connector of the present invention is interposed between the musical instrument and the jack leading to the electronic amplifier which amplifier jack, in the prior art, is normally plugged directly into the jack receptacle of the musical instrument.

The jack of the electro-acoustic connector of the present invention is a modified form of the prior art jack in that it is adapted to transmit both electrical signals from the transducer on the musical instrument and soundwaves from the musical instrument. At least one aperture is provided in the shaft of the jack for transmission of soundwaves from the musical instrument to a microphone contained in the electro-acoustic connector, the microphone generating electrical signals corresponding to the soundwaves.

The electro-acoustic connector of the present invention includes a three-position switch permitting the performer to control transmission to the electronic amplifier of electrical signals from the musical instrument and electrical signals from the microphone. Thus, the amplifier may receive electrical signals directly from the transducer of the musical instrument or electrical signals from the microphone which electrical signals are generated by the soundwaves emitted by the musical instrument or a combination of electrical signals received directly from the transducer of the musical instrument and from the microphone.

BRIEF DESCRIPTION OF THE DRAWINGS

FIG. 1 is a perspective view of a musical instrument electrically connected to an amplifier-speaker through the electro-acoustic connector of the present invention;

FIG. 4 is a cross-sectional view of a portion of the musical instrument of FIG. 1 showing the electro-acoustic connector connected to the musical instrument;

FIG. 5 is a circuit diagram of the electro-acoustic connector of FIG. 2.

DETAILED DESCRIPTION OF THE PREFERRED EMBODIMENT

Figure 2:
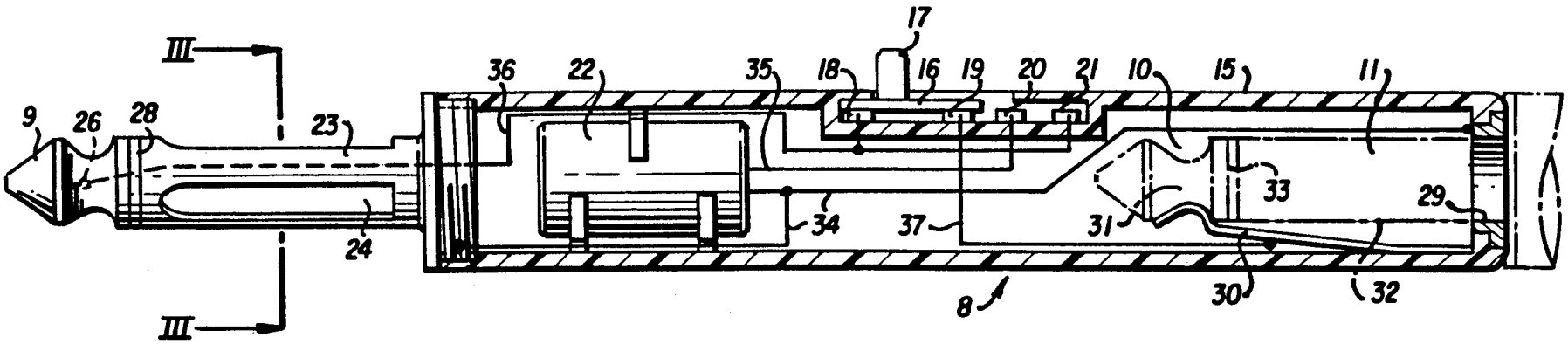
FIG. 2 is a side view, partially in cross-section, of the electro-acoustic connector.
Figure 3:
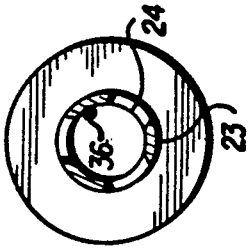
FIG. 3 is a cross-sectional view of the electro-acoustic connector taken along the line III—III of FIG. 2.

FIG. 1 illustrates a guitar 1 having a conventional electrical vibration transducer or magnetic pickup 2 connected by electrical conductors to volume control 3 and tone control 4 and to a jack receptacle 5 mounted in the guitar. The jack receptacle 5 projects into a chamber 6 (FIG. 4) located in the body 7 of the guitar. The guitar body is usually made of wood. The electro-acoustic connector 8 of the present invention has a jack 9 inserted in the receptacle 5 on the guitar, and a jack receptacle 10 (FIG. 2) for receiving a jack 11 connected by cable 12 to an amplifier 13 associated with a speaker cabinet 14.

Referring to FIG. 2 the electro-acoustic connector 8 comprises a cylindrical housing 15 made of an electrical insulating material and having a slot 16 through which projects a three-position switch 17 for engaging four electrical terminals 18, 19, 20 and 21. At one end of the housing 15 projects a jack 9 and at the opposite end of the housing is a jack receptacle 10 for receiving jack 11 connected to the cable 12 leading to the amplifier 13.

A microphone 22 is mounted within the housing 15 adjacent the base of the jack 9. The shaft 23 of the jack 9 is a hollow cylindrical member with a plurality of apertures 24. The conventional jack receptacle 5 in the wall of the guitar body 7 includes an annular collar 39 which makes electrical contact with the shaft 23 of the jack 9 and a retention spring member 25 which engages and makes electrical contact with a notch 26 in the jack 9 to retain the jack in position projecting into the chamber 6. Insulators 40 and 41 electrically isolate the spring member 25 from the collar 39. An insulator 28 electrically isolates the end of the jack, including the notch 26, from the hollow shaft 23. Sound generated by the strings 27 of the guitar are transmitted through the body 7 to the chamber 6 from which they are transmitted through apertures 24 in the shaft 23 of the jack 9 to the microphone 22.

The jack receptacle 10 comprises a collar 29 in the end of the cylindrical housing 15 opposite the jack 9 for receiving the jack 11 connected by cable 12 to the amplifier 13. The jack 11 is retained in position by a retention spring member 30 extending from the housing 15 and contacting a notch 31 in the jack 11, which notch is electrically isolated from the shaft 32 by an insulator 33.

One terminal of the microphone 22 is electrically connected to the base of the shaft 23 of the jack 9 and to the collar 29 by connecting wires 34. The other terminal of the microphone is electrically connected to switch contact 20 by wire 35. The notch 26 of jack 9 is electrically connected by wire 36 to both switch contacts 18 and 21. The retention spring 30 is electrically connected by wire 37 to switch contact 19.

Figure 6:
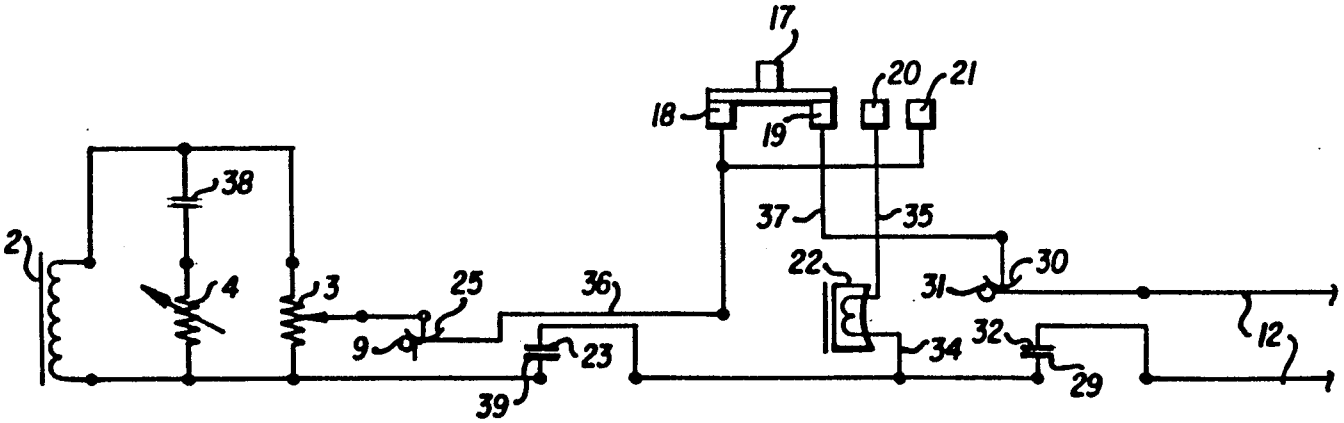
FIG. 6 is the circuit diagram of the electro-acoustic connector as shown in FIG. 2 connected to a typical electrical circuit of the amplified musical instrument of FIG. 1.

Referring to FIG. 6, the magnetic pickup on the guitar 2 is electrically connected in parallel to the tone control variable resistor 4, in series with a capacitor 38, and the volume control potentiometer 3. The output from the volume control is connected to the collar 39 and retention spring member 25 of the jack receptacle 5 which in turn are electrically connected to the shaft 23 and notch 26 of the jack 9 of the electro-acoustic connector 8.

By utilizing the switch 17 in the electro-acoustic connector, it is possible to connect to the amplifier 13 either electrical signals from the magnetic pickup 2 or electrical signals from the microphone 22 or both electrical signals from the magnetic pickup 2 and the microphone 22. With the switch 17 connecting only terminals 18 and 19, as shown in FIGS. 2, 5 and 6, only electrical signals from the magnetic pickup 2 are conducted to the amplifier. With the switch 17 moved one position to the right, only terminals 19 and 20 are connected. In this position, electrical signals from only the microphone 22, which is activated by sound vibrations transmitted from the strings 27 through the body 7, chamber 6, and apertures 24 in the jack 9, are transmitted to the amplifier 13. With the switch moved further to the right, terminals 19, 20 and 21 are connected resulting in transmission of electrical signals to the amplifier 13 from both the magnetic pickup 2 and the microphone 22.

It will be appreciated that by utilizing the versatility of the electro-acoustic connector the quality of the sound emitted by the speaker 14 can be varied by controlling the switch on the connector to transmit either only signals from the magnetic pickup or only signals from the microphone or both electrical signals from the magnetic pickup and the microphone. This can be accomplished utilizing the electro-acoustic connector without any modification of the standard musical instrument or amplifier.

While it is apparent that the principles of the invention are well calculated to fulfill the above stated objects, it will be understood that the invention is subject to modification, variation, and change without departing from the proper spirit or scope of the invention as defined in the appended claims.

I claim:

1. An electro-acoustic connector for connecting a musical instrument to an electronic amplifier and adapted to receive both electrical signals from a transducer associated with said musical instrument and soundwaves produced by said musical instrument, said musical instrument having outlet means for transmitting said electrical signals and soundwaves, and electro-acoustic connector comprising a housing including a combined electrical and acoustic inlet means adapted for connection to said outlet means of said musical instrument for receiving said electrical signals and soundwaves from said outlet means of said musical instrument, said inlet means being adapted for transmitting soundwaves from said outlet means of said musical instrument into said housing, a microphone disposed in said housing for receiving said soundwaves transmitted from said outlet means of said musical instrument and generating electrical signals in response to said soundwaves, electrical outlet means in said housing for receiving electrical inlet means connected to an electronic amplifier, said electrical outlet means being adapted for transmitting electrical signals from said combined electrical and acoustic inlet means to said electrical outlet means, multiple contact switch means, and electrical conductor means connecting said combined electrical and acoustic inlet means, said microphone and said electrical outlet means to said switch means, said switch means being adapted to connect only said combined electrical and acoustic inlet means to said electrical outlet means or connect only said microphone to said electrical outlet means whereby electrical signals transmitted from said inlet means or from said microphone are transmitted to said electrical outlet means.

2. An electro-acoustic connector according to claim 1 wherein said switch means is further adapted to connect both said combined electrical and acoustic inlet means and said microphone to said electrical outlet means.

3. An electro-acoustic connector for connecting a musical instrument to an electronic amplifier and adapted to receive both electrical signals from a transducer associated with said musical instrument and soundwaves produced by said musical instrument, said musical instrument having a jack receptacle for transmitting said electrical signals and soundwaves, said electro-acoustic connector comprising a housing defining a chamber, a jack projecting from said housing adapted to be received in said jack receptacle of said musical instrument, said jack being adapted to receive and transmit electrical signals from said jack receptacle in said musical instrument and having at least one aperture therein communicating with said chamber of said housing for transmitting soundwaves from the exterior of said jack through said at least one aperture into said chamber, a microphone disposed in said chamber in said housing for receiving said soundwaves transmitted through said at least one aperture in said jack and generating electrical signals in response to said soundwaves, an electrical jack receptacle in said housing for receiving a further jack connected to an electronic amplifier, multiple contact switch means, and electrical conductor means connecting said jack, said microphone and said electrical jack receptacle to said switch means, said switch means being adapted to connect only said jack to said electrical jack receptacle or connect only said microphone and said electrical jack receptacle whereby electrical signals transmitted from said jack or from said microphone are transmitted to said electrical jack receptacle.

4. An electro-acoustic connector according to claim 3 wherein said switch means is further adapted to connect both said jack and said microphone to said electrical jack receptacle.

5. An electro-acoustic connector for connecting a musical instrument to an electronic amplifier and adapted to receive both electrical signals from a transducer associated with said musical instrument and soundwaves produced by said musical instrument, said musical instrument having outlet means for transmitting said electrical signals and soundwaves, and electro-acoustic connector comprising a housing including a jack adapted to be received in said jack receptacle of said musical instrument, said jack being adapted to receive and transmit electrical signals from said jack receptacle in said musical instrument and having at least one aperture therein communicating with the interior of said housing for transmitting soundwaves from said jack receptacle of said musical instrument through said at least one aperture into said housing, a microphone disposed in said housing for receiving said soundwaves transmitted through said at least one aperture in said jack and generating electrical signals in response to said soundwaves, an electrical jack receptacle in said housing for receiving a further jack connected to an electronic amplifier, multiple contact switch means, and electrical conductor means connecting said jack, said microphone and said electrical jack receptacle to said switch means, said switch means being adapted to connect only said jack to said electrical jack receptacle or connect only said microphone and said electrical jack receptacle whereby electrical signals transmitted from said jack or from said microphone are transmitted to said electrical jack receptacle.

6. An electro-acoustic connector according to claim 5 wherein said switch means is further adapted to connect both said jack and said microphone to said electrical jack receptacle.

* * * * *